United States Patent [19]

Temelli

[11] Patent Number: 4,940,006

[45] Date of Patent: Jul. 10, 1990

[54] PROCESS FOR INCINERATION OF REFUSE

[75] Inventor: Sedat Temelli, Erkrath, Fed. Rep. of Germany

[73] Assignee: Mullverbrennungsanlage Wuppertal GmbH, Fed. Rep. of Germany

[21] Appl. No.: 172,085

[22] Filed: Mar. 23, 1988

[30] Foreign Application Priority Data

Apr. 9, 1987 [DE] Fed. Rep. of Germany ..... 3712039
May 14, 1987 [DE] Fed. Rep. of Germany ..... 3716088

[51] Int. Cl.[5] ..... F23G 5/00

[52] U.S. Cl. ..... 110/243; 110/244; 110/245

[58] Field of Search ..... 110/245, 243, 244

[56] References Cited

U.S. PATENT DOCUMENTS

| | | | |
|---|---|---|---|
| 3,951,081 | 4/1976 | Martin et al. | 110/243 |
| 4,389,979 | 6/1983 | Saxlund | 110/244 |
| 4,538,529 | 9/1985 | Temelli | 110/244 |
| 4,635,573 | 1/1987 | Santen | 110/244 |
| 4,744,312 | 5/1988 | Nanisoko et al. | 110/245 |

FOREIGN PATENT DOCUMENTS

| | | |
|---|---|---|
| 3038875A1 | 10/1980 | Fed. Rep. of Germany . |
| 3125429A1 | 6/1981 | Fed. Rep. of Germany . |
| PCT/US79/-00491 | 7/1979 | PCT Int'l Appl. . |

OTHER PUBLICATIONS

Mull und Obfall, 7/1978.

*Primary Examiner*—Henry C. Yuen
*Attorney, Agent, or Firm*—Jones, Askew & Lunsford

[57] ABSTRACT

Process and apparatus for incinerating refuse or the like in a furnace where the flue gases of combustion are combined with secondary air for afterburning the gases in an afterburning zone. The flue gases are dammed before entering the afterburning zone so as to increase retention time of the flue gases in a zone of uniform temperature in the furnace space, then are accelerated in a venturi-like manner in the afterburning zone, and then are decelerated in a venturi-like manner in the afterburning zone. Secondary air is injected across the front of the afterburning zone in a direction opposite the flow of the flue gases so as to further increase the retention time of the flue gases in the furnace space, and so that the combustible components entrained in the flue gases are burnt completely before entering the afterburning zone.

12 Claims, 3 Drawing Sheets

PROCESS FOR INCINERATION OF REFUSE

Figure 1:
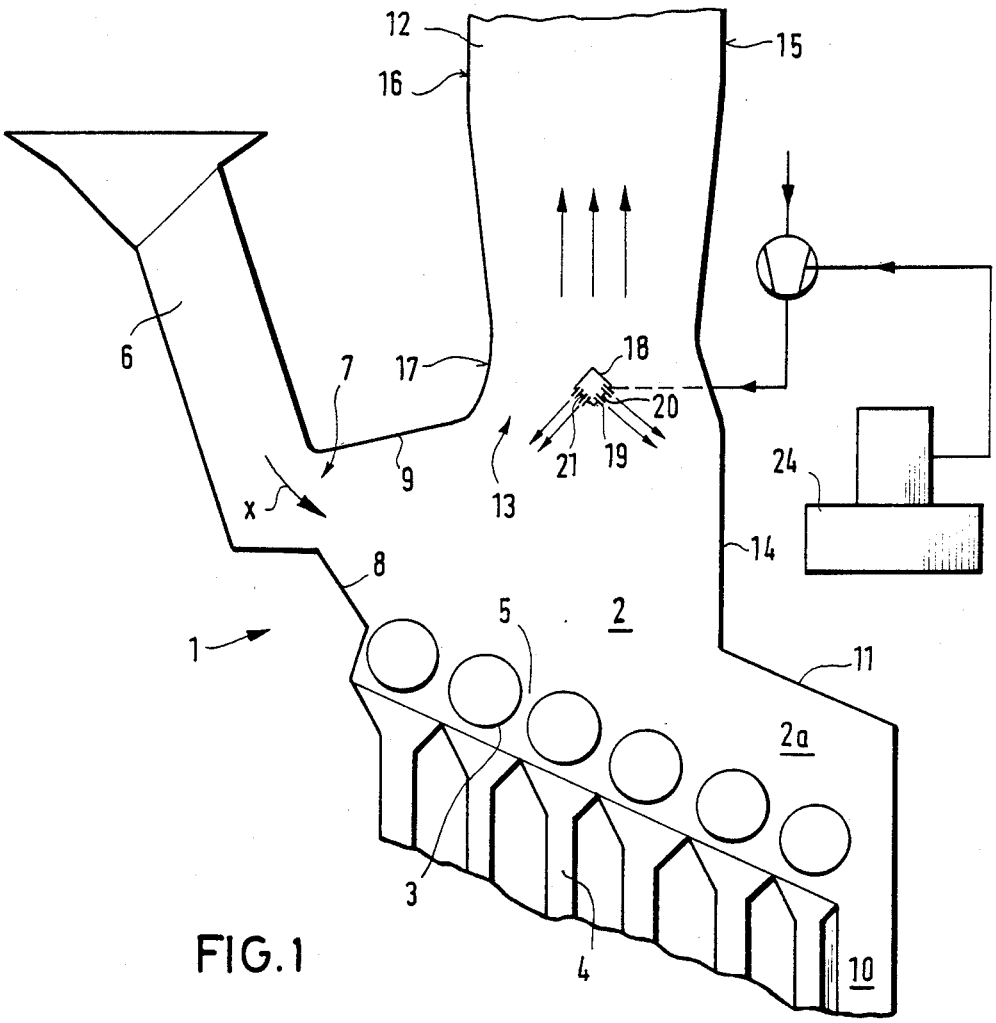

The present invention concerns a process for incineration, especially incineration of refuse, whereby substances to be incinerated are fed into a furnace space and are incinerated on a grate in the body of the furnace and the resultant flue gases are exhausted from the furnace space, and these gases are subjected to turbulence by adding secondary air so that afterburning of the flue gases takes place.

Such a process and a combustion chamber suitable for carrying out this process are known from German Patent No. 3,038,875, for example, where the transition from the furnace space to the flue gas exhaust is constricted by nose-shaped projections on opposite sides of the walls of the body of the furnace. Secondary air is injected in the area of these projections inside the afterburning zone, so the flue gases are subjected to turbulence, which thus yields a thorough mixing of the streams of flue gas formed in the body of the furnace and thus prevents caking and deposits on the inclined wall surfaces of the projections. With this known refuse incineration facility, however, the flue gases that are to be exhausted still contain a high burden of pollutants, especially halogenated hydrocarbons, which is why such incineration plants will no longer meet the requirements to be expected in the future regarding preservation of the quality of air.

The present invention is based on the problem of improving a process of the type described initially in such a way that the flue gases can be guided and mixed so as to cause a greatly improved degradation of the pollutants present in the flue gases, especially the halogenated hydrocarbons.

This is achieved according to this invention by the fact that the secondary air is injected over the entire cross section of flow of the flue gases before the flue gases enter the afterburning zone in such a way that the flue gases are decelerated in a uniform temperature zone of the body of the furnace in the direction of exhaust in front of the secondary air injection area. According to this invention, this results in a damming effect of the flue gases within the body of the furnace so the retention time of the flue gases in the body of the furnace is increased. This backup of flue gases takes place in an area of the body of the furnace where an approximately uniform temperature level of 900° to 1050° C. prevails. However, this results in effective degradation of the halogenated hydrocarbons in the flue gas, and due to the intense turbulence in the flue gases created at the same time with the backup of flue gases, a complete separation of the flue gas streams before entering the afterburning zone is thus achieved. According to this invention, it is essential for a uniform temperature zone to be able to develop within the body of the furnace, because only in this way can specific control and thus optimization be achieved through defined injection of secondary air into a defined combustion area. Thus it is advantageous according to this invention for the retention time of the flue gases to be about 8 seconds. In doing so, the secondary air is preferably injected into the body of the furnace at a velocity of flow of about 60 to 90 m/sec.

In addition, it may also be advantageous according to this invention for the afterburning of the flue gases to take place due to acceleration and deceleration of the flue gases following the secondary air injection zone.

Due to this afterburning process which is achieved to advantage by means of a venturi-like constriction in the flue gas exhaust cross section after the secondary air injection area, an additional deceleration of the flue gases before entering the afterburning zone is thus achieved and this supports the deceleration achieved by injection of secondary air in the body of the furnace. It is essentially known from German Patent (OLS) No. 3,125,429 that venturi-like afterburning zones can be used here.

In addition, the present invention also concerns an incineration vessel especially for refuse incineration consisting of a furnace body with a grate and with a feeder above the grate, and the body of the furnace has a throttled area in the upper area opposite the grate and facing in the direction of the flue gas exhaust, and in the area of the throttling there is an air injection system that has several nozzle openings, especially for carrying out the process according to this invention, whereby the injection system for the secondary air is positioned in the direction of flow of the flue gases directly in front of the venturi-like throttled area that is symmetrical with the axis of the flue gas exhaust and the injection system has nozzle openings pointing in the direction of the body of the furnace.

Through the present invention, complete combustion of the flue gases is the result of the deceleration achieved in this way in a defined temperature range of the furnace space where combustion temperatures of about 900° to 1050° C. prevail, thus assuring extensive degradation of the halogenated hydrocarbons, especially the dioxins, in the flue gases. The combustible constituents entrained in the flue gases are also completely burnt out due to the intense supply of oxygen and the thorough mixing in the zone of the furnace preceding the injection zone. This assures a substantial contribution toward improving the PCDD and PCDF emissions.

Additional advantageous versions of this invention are defined in the subclaims and are explained in greater detail below on the basis of the practical examples of this invention illustrated in the accompanying figures.

FIG. 1 shows a cross section through a combustion chamber according to this invention in schematic diagram.

Figure 2:
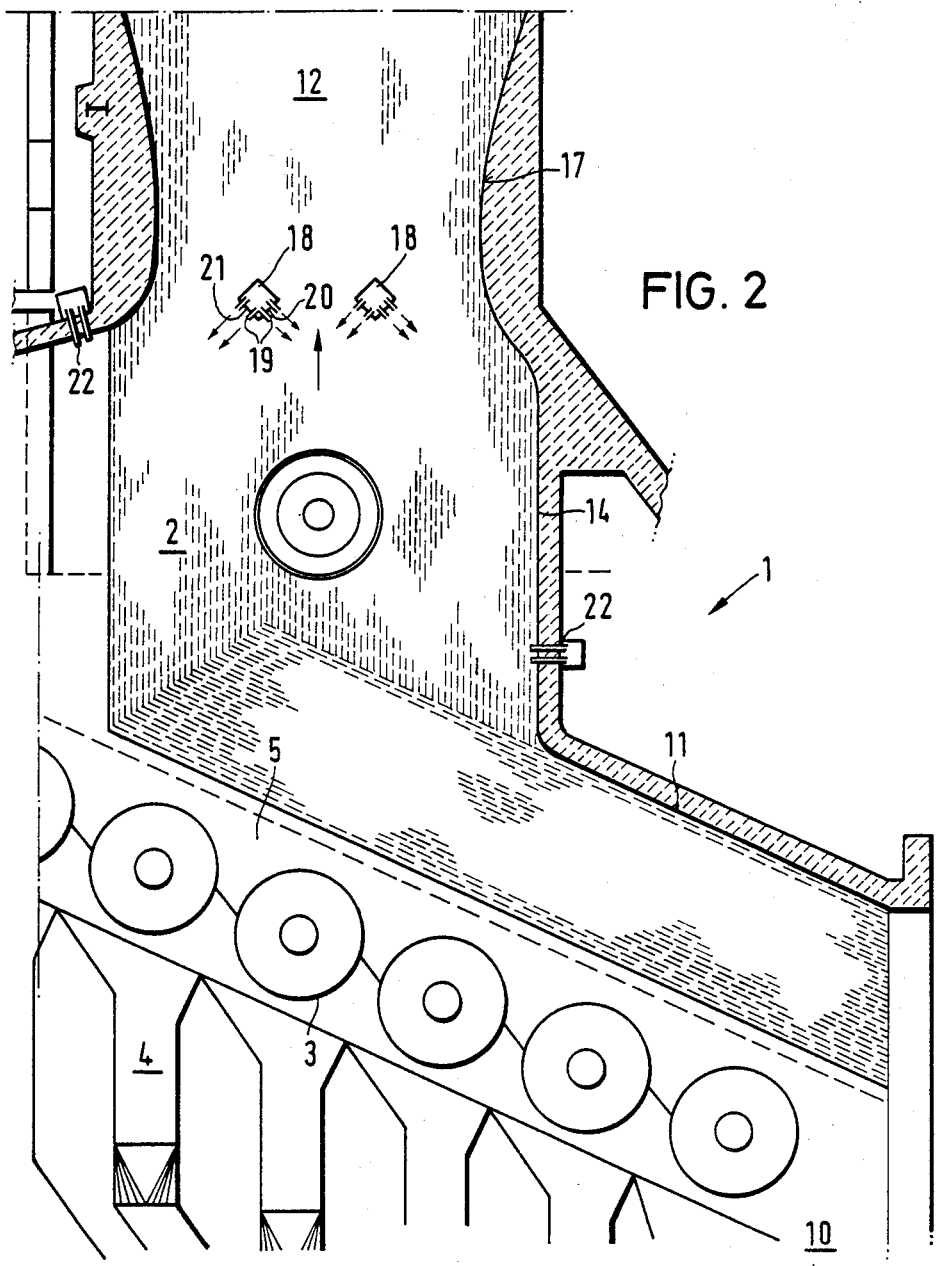
Figure 3:
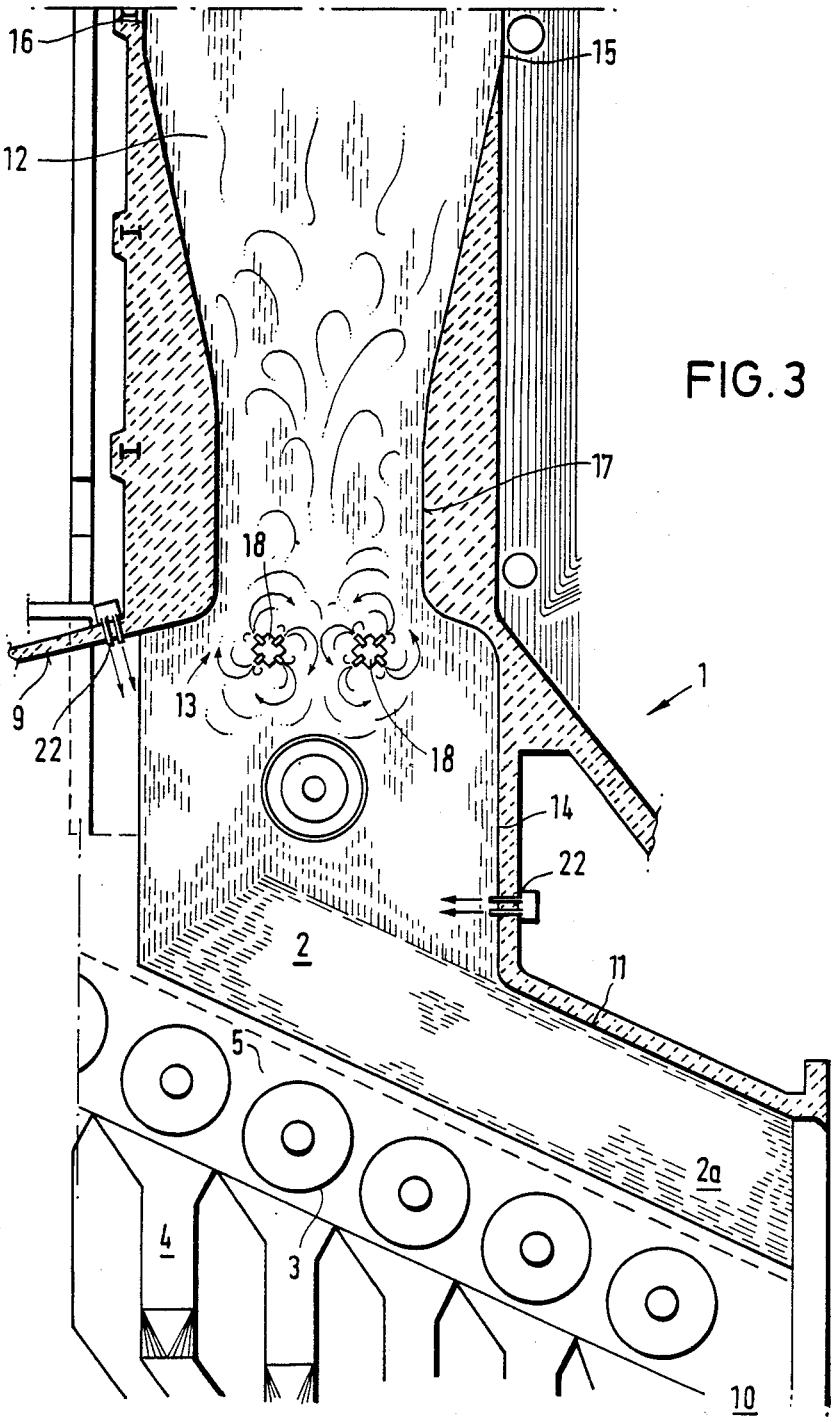

FIGS. 2 and 3 each show a section through another version of a combustion chamber according to this invention.

A combustion chamber 1 according to this invention, especially a refuse incineration chamber as illustrated in FIG. 1, consists of a furnace space 2 with a combustion grate 3 at the bottom. In the practical example shown here, this is a cylinder grate inclined downward to the horizontal. In the practical example illustrated here, the cylinder grate consists of six successive cylinders running parallel to each other. Beneath the incineration grate 3 there are feed lines 4 for supplying cold combustion air, so-called primary air, into the combustion zone 5 surrounding grate 3. The combustion air fed in through lines 4 is drawn in by an undergrate blast fan from the refuse hopper. This intake is done in such a way that the dust load of the intake air is minimized. Due to the large intake cross section, i.e., the low velocity of flow, the air is removed preferably directly at the hopper wall next to the furnace side. Suitable measures assure that the intake noises increase the sound level in the hopper only insignificantly. The primary air intake channels are provided with sufficiently large and readily accessible cleaning ports at the points where dust collects. A refuse feeder 6 opens into the body 2 of the furnace above the upper end of the grate 3 as seen in the direction of transport of the refuse (see arrow X). The outlet opening 7 of the refuse feeder 6 widens over inclined surfaces 8, 9 into furnace space 2. Furnace space 2 above grate 3 consists of a lower section 2*a* above the lower end of the grate in the area of an opening 10 that forms the furnace vessel outlet and the two lower cylinders of the cylinder grate so this section is in approximately the lower third of furnace grate 3 and is bordered at the top by a cover wall 11 that runs parallel to grate 3. The height of section 2*a* above the furnace grate 3, i.e., above the cylinder, corresponds approximately to the diameter of the cylinders. This zone corresponds approximately to the cooling zone of the combustion slag. Following section 2*a*, the furnace space 2 widens toward the top and opens into a flue gas exhaust 12 where the width of flue gas exhaust 12 corresponds approximately to half the length of grate 3 and in the practical example shown here is about 5 m, namely in adaptation to the desired combustion capacity of the incineration vessel 1 according to this invention. The approximately horizontal connecting opening 13 between the furnace space 2 and flue gas exhaust 12 is immediately above the opening of refuse feeder 6 and forms a flow cross section that is symmetrical with the axis of the flue gas exhaust. The furnace space 2 has a rear wall 14 that extends vertically upward from cover wall 11 and is extended directly into rear wall 15 of flue gas exhaust 12. Front wall 16 of flue gas exhaust 12 runs parallel to its rear wall 15 and extends upward from the end of inclined face 9 that is connected to the refuse feeder 6. The area of the flue gas exhaust 12 directly in the direction of flow of the flue gases after connecting opening 13 has a throttled area 17 which is likewise symmetrical with the flue gas exhaust axis and in the advantageous version illustrated here is designed in the manner of a venturi tube. This venturi-like zone 17 has an afterburner chamber where the flue gas mixture is first accelerated to about 8 to 10 m/sec and then is decelerated to about 4 to 5 m/sec. This results in relative movements within the flue gas flow so there is intense mixing of the flue gas streams and temperature streams. This causes improved combustion of the flue gas mixture and thus increased decomposition of the residual pollutants contained in it, especially the halogenated residual hydrocarbons (e.g., dioxins) contained in the flue gas.

The smooth surface and relatively high design of the furnace space 2 according to this invention with a preferably rectangular or square cross section above the drying and combustion zone of the combustion grate 3 without projections and noses prevents the development of caked-on deposits. In addition, the design according to this invention also permits a uniform flow of flue gases and the development of defined combustion zones, so the combustion properties are improved in the sense of a uniform combustion. This is further supported by the fact that due to the throttled area in the outlet of the furnace space, first there is the effect of damming up the flue gases which thereby lengthens the retention time of the flue gases in the furnace space, and this is also especially advantageous because there is a temperature zone where the temperature is in the range of about 900° to 1050° C. precisely in the area before the throttled zone, and this temperature range in particular is crucial for incineration of the halogenated hydrocarbons present in the flue gases.

Furthermore, it is advantageous for an injection system 18 for additional incoming air to be provided inside the connecting opening 13 between furnace space 2 and flue gas exhaust 12, i.e., in front of the entrance into the venturilike zone 17. This air that is supplied through injection system 18 is referred to below as secondary air. The secondary air injection system 18 is designed in such a way that the jets of air leaving it form an almost continuous grid so no streams of flue gas can penetrate into this area without coming in intimate contact with the injected secondary air. In the practical example illustrated here, this injection system 18 consists of a nozzle bar that extends across the direction of the flue gas flow from the front side of the flue gas exhaust 12 to the rear side and is mounted in the walls. Depending on the size of the cross section of connecting opening 13, however, two or more parallel nozzle bars 18 may be provided a certain distance apart. Such a nozzle bar 18 according to this invention consists of a pressure-resistant, heat-resistant material and preferably has an approximately square or circular cross section, with nozzle openings 19 in two adjacent sides in a linear arrangement in the box sides 20, 21. Such a nozzle bar is known from German Patent No. 3,038,875, but in the present invention it acts precisely in the opposite direction from that according to German Patent No. 3,038,875. Nozzle bar 18 is arranged in such a way that the box sides 20, 21 having the nozzle openings 19 run at an angle to the longitudinal axis of the flue gas exhaust, preferably at an inside angle of 45° facing the furnace space 2. Due to the linear arrangement of nozzle openings 19, the air jets emitted from them form a complete grid with no gaps so no flue gas streams can penetrate through this area without being intensely mixed with the injected air. The direction of injection of the secondary air is opposite the exhaust direction of the flue gas so this creates turbulence and a separation of the flue gases in the area in front of the throttled zone 17 so the retention time of the flue gases in this area where the temperature is at a level of 900° to 1050° C. is also increased to about 8 seconds. This assures combustion of the halogenated hydrocarbons. The secondary air can leave nozzle openings 19 at a rate of more than 60 to 90 m/sec. In addition, the air injection causes the combustible constituents that are entrained in the flue gases to be burnt out completely in the upper zone of the furnace space due to the intense supply of oxygen. Complete burnup in all operating states within the furnace performance diagram is assured due to the newly developed design of the furnace space just as well as the formation of halogenated hydrocarbons is likewise prevented. Definitely positive results with regard to the presence of PCDDs and PCDFs have been obtained in studies where there is an increase in turbulence and retention time of the combustion gases in hot temperature zones such as that achieved according to this invention. According to information presently available, it is possible to degrade the unwanted components such as halogenated hydrocarbons when refuse incineration is carried out at combustion temperatures at which homogeneous heating of the flue gases to 1000° C. is assured for a period of 2 seconds.

In addition, tertiary air nozzles 22 may also be provided to advantage in the front wall in the area of inclined face 9 just before the transition to the venturilike zone 17 as well as in the rear wall 14 just before the end of the cover wall 11 as illustrated in FIG. 2. These tertiary air nozzles inject tertiary air into the flue gas stream at a velocity of preferably more than 60 m/sec. This should assure thorough mixing so the depth of penetration of the air jets and the distribution of the nozzles are such that the flue gas stream is influenced completely, especially in the area of the wall. These nozzles are advantageous as a supplement to the nozzle bars 18, because they permit adequate injection of air especially in the areas near the wall in order to achieve complete combustion even in this area.

The secondary and tertiary systems are completely separated from the primary air system. The intake is through separate air fans below the furnace cover. With regard to noise, all the intake channels and air channels on the pressure side are of such dimensions that the velocity of flow does not exceed 15 m/sec. In addition, it is also advantageous for the air channels to be sufficiently reinforced and for the connections of the channels and the suspensions on the building parts, the furnace and furnace structure to be designed so they are elastic and tend to minimize structure-borne noise.

The supply of secondary air and preferably also tertiary air according to this invention makes it possible to reduce the amount of primary air supplied to about $\lambda=1$ to 1.2 ($\lambda$=excess air coefficient), so complete combustion takes place in combustion zone 5 and the combustion process is delayed. This reduces the formation of $NO_x$ gas in the furnace space. The supply of secondary air according to this invention with mixing in venturi tube 17 assures complete combustion and maintenance of an excess air coefficient of about $\lambda=1.5$ to 1.8 in the flue gas exhaust. Thus the $NO_x$ content in the flue gas can be reduced on the whole according to this invention while still achieving complete combustion.

In another modification of this invention, it may be expedient to have an ammonia plant 24 connected to the secondary air system as illustrated in FIG. 1. This makes it possible according to this invention to inject ammonia through the nozzle bar 18 into the area of the connecting opening 13 so the ammonia is thoroughly mixed with the flue gas stream there, and injection takes place in a furnace area where an effective temperature level of about 1000° C. prevails. At this temperature level, the nitrogen oxide content is 5 to 10% $NO_2$ and 90 to 95% NO. By injecting ammonia according to this invention in the area of the connecting opening in front of venturi tube 17, this results in selective reduction of the nitrogen oxides, so nitrogen and water are formed by adding ammonia, and this is accomplished without the need for catalysts. Here again, this invention assures uniform permeation of ammonia through the flue gas, and this takes place in the furnace space and also in the afterburning area of the venturi-like zone following the furnace space. German Patent No. 2,411,672 describes a process for removing nitrogen monoxide from combustion exhaust gases that contain oxygen by means of selective reduction with ammonia, but this process principle can be applied to refuse incineration only in combination with the arrangement according to this invention and the principle of injection of ammonia according to this invention with the secondary air system according to this invention, which yields a mixture of secondary air and ammonia.

This invention also makes it possible to control or regulate the supply of secondary air and/or the ammonia supply depending on the temperature prevailing in the secondary air injection zone as measured by a temperature probe mounted on the nozzle bar. The temperature can be raised or lowered by increasing or reducing the secondary air values.

In the practical example illustrated according to FIG. 3, this injection system consists preferably of two nozzle bars 18 that extend across the direction of the flue gas stream from the front side of the flue gas exhaust 12 to the back side and mounted in the walls so they can rotate by means of fixed and loose bearings. The rotational speed and direction of rotation of the nozzle bars can be regulated continuously.

The flue gas formed by incineration on the cylinder grate 3 is mixed even more thoroughly, especially due to the rotating flow of the atmospheric oxygen. This forms preferably two contrarotational rolls of fire.

Otherwise the same parts as shown in FIGS. 1 and 2 are provided with the same reference numbers.

I claim:

1. Process for incineration of refuse or the like, where the substances to be burned enter a furnace space and are burned on a grate in the furnace space, and the flue gases formed by combustion are exhausted from the furnace space through a throttled portion and turbulence is created in the gases by adding secondary air for the purpose of afterburning of the flue gases in an afterburning zone, comprising the steps of damming the flue gases before entering the afterburning zone so as to increase the retention time of the flue gases in the furnace space in a uniform temperature zone of the furnace space, and then accelerating the flow of flue gases in a venturi-like manner in the afterburning zone, and then decelerating the flow of flue gases in a venturi-like manner in the afterburning zone; and injecting the secondary air below the throttle portion across the entire cross section of flow of the flue gases in front of the point of entrance of the flue gases into the afterburning zone in a direction opposite to the flow of the flue gases toward the afterburning zone, so that the flue gases are additionally decelerated in said uniform temperature zone of the furnace space so as to further increase the residence time of the flue gases in the furnace space, and so that the combustible constituents entrained in the flue gases are burnt out completely before entering the afterburning zone;

so as to reduce the unwanted gaseous components in the flue gases.

2. Process according to claim 1, wherein the flow rate of the secondary air is sufficient to cause deceleration of the flue gases so that the flue gases achieve a residence time of about 8 seconds.

3. Process according to claims 1 or 2, comprising the step of injecting the secondary air at a velocity of flow of about 60 to 90 m/sec.

4. Process according to claim 1, comprising the step of injecting the secondary air in an area of the furnace space at a temperature level of 900° to 1050° C.

5. Process according to claim 1, comprising the step of injecting the secondary air in thin streams close together, at an angle of about 45° to the direction of exhaust of the flue gases.

6. The process as in claim 1, wherein:

the secondary air forms a substantially continuous grid across the entire cross section of flow of the flue gases, so that no stream of the flue gas can enter the afterburning zone without coming into intimate contact with the injected secondary air.

7. Process according to claim 1, comprising the step of injecting the secondary air on a circular path.

8. Process according to claim 1, comprising the step of controlling the velocity of the injected secondary air as a function of the furnace temperature in the injection area to accomplish more thorough turbulent mixing of the air with the flue gases.

9. Process according to claim 8, comprising the further step of reducing the velocity of low of the flue gases to approximately the same velocity of flow as in the furnace space after the step of increasing velocity in the afterburning zone.

10. Process according to claim 1, comprising the further step of injecting tertiary air in front of the transition from the furnace space to the flue gas exhaust at a velocity of at least 60 m/sec.

11. Process according to claim 1, comprising the further step of injecting ammonia into the flue gas stream together with the secondary air, for reduction of nitrogen oxides in the flue gases.

12. Process according to claim 11, wherein the ammonia is injected into an area of the furnace space where an effective temperature of about 1000° C. prevails.

* * * * *